US006814113B1

(12) United States Patent
Daniels

(10) Patent No.: US 6,814,113 B1
(45) Date of Patent: Nov. 9, 2004

(54) MANUFACTURING METHOD FOR PRODUCING THREE DIMENSIONAL INLAID TURNED AND RE-SAWN WOOD PRODUCTS

(76) Inventor: Ronald G. Daniels, 1184 Le Mars Ave., Port Charlotte, FL (US) 33948

( * ) Notice: Subject to any disclaimer, the term of this patent is extended or adjusted under 35 U.S.C. 154(b) by 0 days.

(21) Appl. No.: 10/323,573

(22) Filed: Dec. 18, 2002

(51) Int. Cl.[7] ..... B27D 1/08

(52) U.S. Cl. ..... 144/351; 144/352; 156/182; 156/256; 428/537.1

(58) Field of Search ..... 149/344, 346, 149/347, 348, 349, 350, 351, 352; 156/60, 153, 154, 182, 250, 256; 428/195.1, 201, 537.1, 44, 10; 473/1, 2, 44, 45, 46

(56) References Cited

U.S. PATENT DOCUMENTS 1,936,182 A * 11/1933 Beiger ..... 427/259
2,057,882 A * 10/1936 Crowley ..... 524/13
2,062,175 A * 11/1936 Hartman ..... 144/351
4,486,371 A * 12/1984 Caliri ..... 264/78
4,949,965 A * 8/1990 Ross et al. ..... 473/2
5,218,371 A * 6/1993 Copeland et al. ..... 343/742
6,576,079 B1 * 6/2003 Kai ..... 156/182
2001/0033919 A1 * 10/2001 Muller et al. ..... 428/209

* cited by examiner

*Primary Examiner*—Allen Ostrager
(74) *Attorney, Agent, or Firm*—Frank A. Lukasik

(57) ABSTRACT

An artistic, decorative, durable and dimensionally stable laminate form having the appearance of ribbons laced and interspersed throughout the form consisting of a length of wood having a plurality of longitudinal, "X" axis, wave form cuts formed therethough, a strip of contrasting, flexible material being bonded between each of the wave form cuts forming a laminate matrix, a plurality of "Y" axis, wave form cuts formed therethough, a strip of contrasting, flexible material being bonded between each of the wave form cuts forming a laminate matrix, and machining the laminate matrix to the desired form, such as a pool cue stick, a furniture item, or a sports item.

8 Claims, 3 Drawing Sheets

MANUFACTURING METHOD FOR PRODUCING THREE DIMENSIONAL INLAID TURNED AND RE-SAWN WOOD PRODUCTS

BACKGROUND OF THE INVENTION.

The present invention relates to laminated wood products and, more particularly, to lathe-turned wood products composed of laminated layers of wood varieties assembled into a matrix from which a multiplicity of dimensionally stable and uniquely decorative wood products may be produced.

Decorative wood working using lamination has been for hundreds of years an art form from which many enduring and unique wooden artifacts have been produced. With the advent of modern technology and adhesives, wood laminates and inlays of great beauty and durability have appeared which have both structural integrity and esthetic appeal.

SUMMARY OF THE INVENTION

The present invention teaches that a variety of previously undiscovered laminated wooden artifacts may be produced using traditional wood turning techniques. The invention discloses as a first embodiment, a pool cue which is produced from an assembly of contrasting wooden laminates held together by modern, durable, waterproof adhesives. The invention discloses examples of how wood laminates may be assembled from contrasting layers of wood into a machineable matrix which may be used to form unique wood products.

Prior art pool cues have been manufactured from stable wooden bases which have been decorated thereafter by the application of inlays of contrasting substances such as ivory, mother of pearl etc. Pool cues generally are composed of two pieces, each being fitted with metal hardware allowing them to be connected with an often decorative male/female screw joint.

Decoration of a pool cue has to be done in such a way as to provide a smooth uninterrupted surface which may slide easily over the surface of a players' hands. The present invention teaches that a pool cue may be manufactured economically while simultaneously displaying rich and complex decorative elements using simple lamination and wood-turning techniques.

Accordingly, several objects and advantages of the present invention are:

To provide a method for combining disparate and contrasting wood elements to form thereby a laminated matrix from which decorative, dimensionally stable, warp resistant products can be formed by turning, carving or otherwise shaping the material of the matrix.

To produce uniquely decorated pool/billiard cues having an artistic appearance caused by ribbons laced through wood.

To produce machined wood products in any shape or form each having an artistic appearance either uniquely or having a predetermined pattern common to a number of such products. To produce laminated products as described in the present invention, which may be comprised of both wood and non wood elements in order to produce further decorative variety.

DESCRIPTION OF THE INVENTION

The present invention pool cue is created by assembling pieces of wood into a blank which is thereafter turned to produce the cue. The process begins by joining two nominal pieces of wood—which can vary in size from widths of ¼" to 8", heights of ¼" to 16" and lengths from 1" to 20". High quality polyurethane or an epoxy adhesive are used to join the pieces. Once dry, the materials are cut twice or more from north to south (X axis) using a wave form cut pattern. The resulting wave form surfaces are then covered with thin strips of a dissimilar and contrasting wood which is glued in place and clamped under high pressure within a sandwich formed by the original cut pieces of wood. Once dry, the composite/lamination is now cut lengthwise on the Y axis again using a wave form cut or cuts. Once again, thin pieces of contrasting wood are sandwiched in the sawn areas and glued and clamped until dry.

The assembled matrix can be turned on a lathe to produce structural or decorative products having vivid patterns which appear variously as ovals, crosses, figures of eight or virtually any symmetrical or non symmetrical patterns that can be completely random or exact depending on the nature of the matrix and the method used to shape the finished piece. The process can be used to produce repeating constant patterns by creating each new laminated piece using the same cutting and laminating pattern.

The process as described can be used to produce various products other than pool (billiard) cues, such as, but not limited to; balustrades, furniture components, columns (including structural columns) newel posts, dowels, baseball bats, bed posts and martial arts weapons. The process is not limited to length, width, depth of material or the number and magnitude of wave form cuts used.

The manufacturing process structurally re-engineers the wood components to produce a rigid product which is dimensionally stable, warp resistant and which has an attractive artistic appearance caused by laminate ribbons laced through the wood.

DETAILED DESCRIPTION OF A PREFERRED EMBODIMENT

Figure 1:
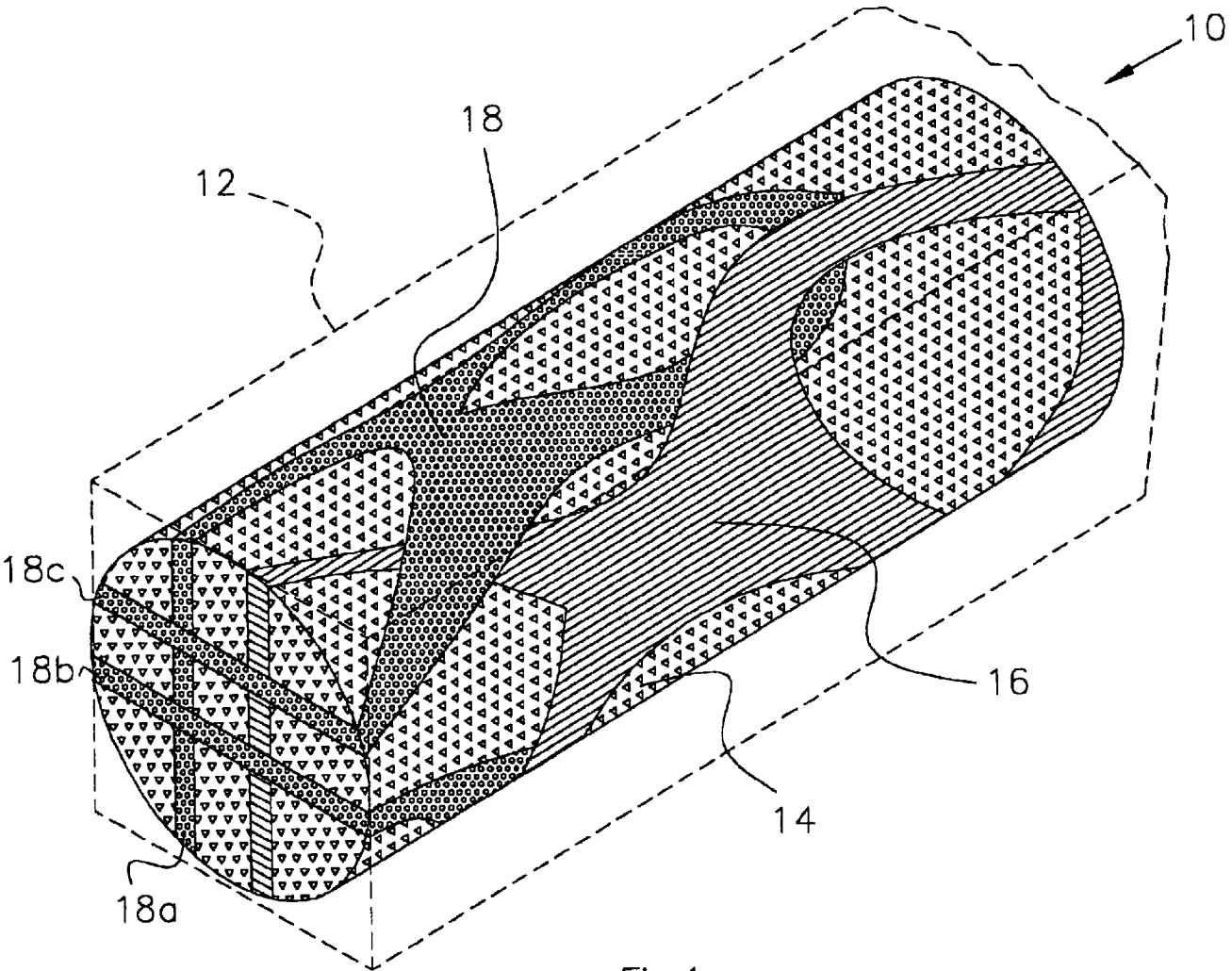
FIG. 1 is an isometric view, partially in section, showing a generic lathe turned laminated matrix, in this example as a section of a pool cue, illustrating the use of laminate strips as decorative elements.

Referring now to the drawings in which like numerals designate like and corresponding parts throughout the several views, in FIG. 1, the invention is designated overall by the numeral 10. Matrix 12 is shown in broken section to illustrate its form and size prior to machining. Matrix 12 is composed of wood layers 14, 16 and 18. FIGS. 18*a*–18*c* denote the cross sectional ends of laminate layer 18 to illustrate the relationship between layers 14, 16 and 18.

Figure 2:
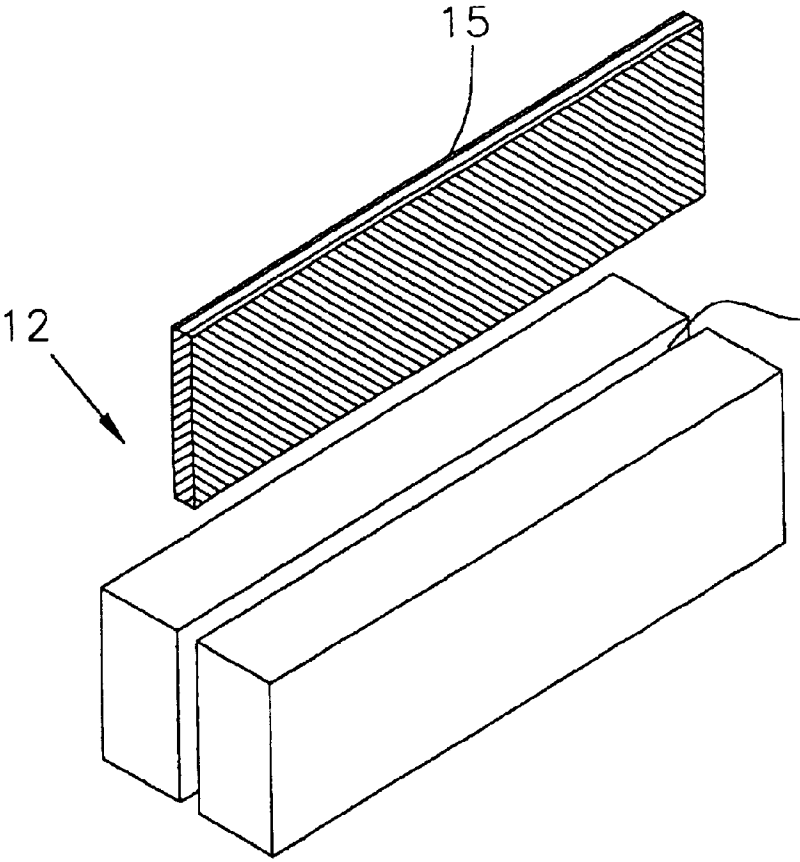
FIG. 2 is an isometric view of a typical lamination showing the laminate being offered up between two wood pieces which have been cut longitudinally.

FIG. 2 illustrates the basic principles of lamination wherein two pieces of wood or other material 12, are separated and a slice of contrasting material 15 is interposed between them in space 13.

Figure 3:
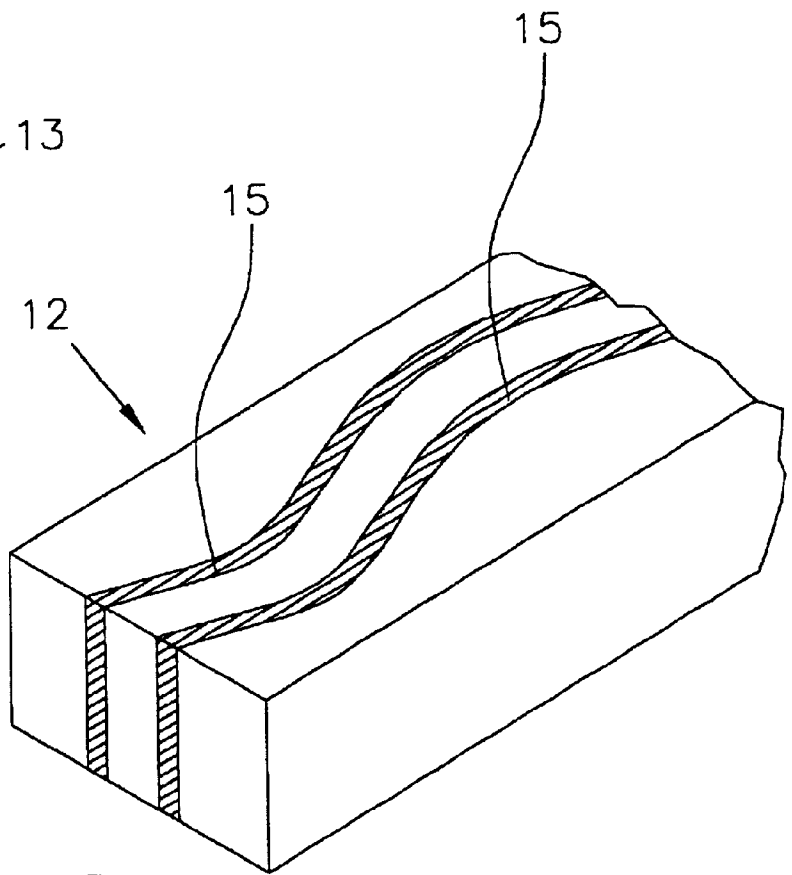
FIG. 3 is an isometric view of a variation of normal lamination illustrating the use of curve or wave form laminates.

FIG. 3 illustrates a variation on the theme of FIG. 2 in that the laminate layer 15 is curved or wave formed. This variation is the essence of the present invention in that wave form laminates when machined or lathe turned, are uniformly ablated by a cutting means and are revealed beneath as decorative ribbons of contrasting material because their presence within the matrix is deliberately non uniform.

Figure 4:
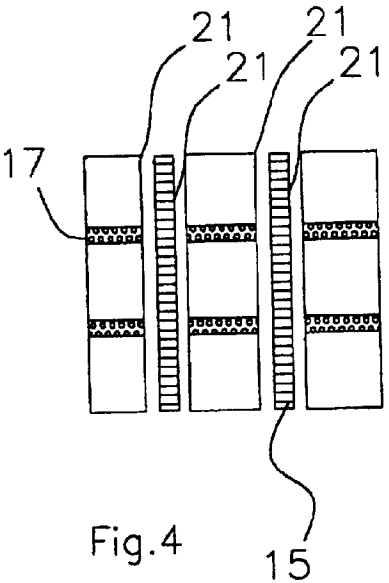
FIG. 4 is an end elevation of a laminate block illustrating the glue surfaces.

FIG. 4 illustrates the relationship between laminate strips 15 and gluing surfaces 21. The laminate strips 15 may consist of wood veneers of 1/25"–1/4 maple, cherry, walnut, or other hardwood. The process may be begun by gluing two wood layers 14 and 16 together or gluing a slice of contrasting material laminate strip 15 between the two wood layers 14 and 16.

Figure 5:
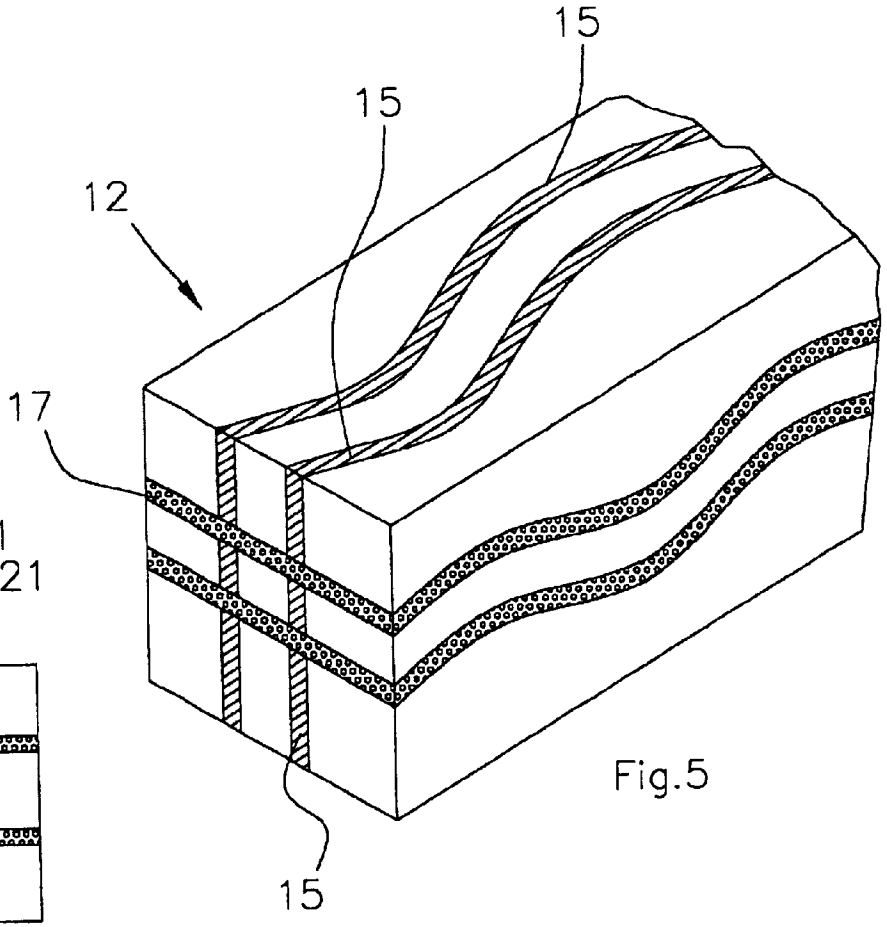
FIG. 5 is an isometric view of a laminated matrix as described in the invention, prior to any machining/lathe turning.

FIG. 5 shows the appearance of a completed laminate matrix 12 prior to machining. Laminate strips 15 and 17 are interspersed throughout the matrix such that they would be revealed after machining, similarly to those shown in FIG. 1.

What is claimed is:

1. A method of creating, from assembled laminate forms, artistic, decorative, durable, and dimensionally stable objects with surface characteristics that have the appearance of ribbons laced and interspersed throughout the object, said method comprising the steps of:

cutting lengths of wood into shapes and dimensions of sufficient size to provide material enough to make the intended object, making a plurality of longitudinal, "X" axis, wave form cuts in said lengths of wood to separate into a plurality of parts of said wood, thereby providing wave form surfaces common to each of said parts, interposing a laminate strip of contrasting material between each of said parts of said wood, said laminate strips each having characteristics of flexibility sufficient to conform with said wave form cut surfaces, applying suitable adhesive material to said wave form cut surfaces and to both sides of each of said strips, clamping said lengths of wood and said strips so as to trap said strips between said wave form surfaces for sufficient time to allow said adhesive to form a complete bond between said strips and said surfaces, thereby forming a laminate matrix, making a plurality of longitudinal, "Y" Axis, wave form cuts through said laminate matrix, for creating separate parts having multiple wave form surfaces thereby, interposing a plurality of laminate strips of contrasting material between said separate parts, said laminate strips having characteristics of flexibility sufficient to conform with said wave form surfaces, applying suitable adhesive material to said wave form surfaces and to both sides of said strip, clamping said separate parts and said strips so as to trap said strips between said wave form surfaces for sufficient time to allow said adhesive material to form a complete bond between said strips and said separate parts, thereby forming a laminate matrix having a plurality of laminate strips interspersed perpendicular to each other throughout said matrix, and, machining said matrix to such dimensions as required for the intended product for revealing decorative ribbons of contrasting material, and surface finishing said product such that the surface characteristics are enhanced thereby.

2. The process of claim 1 wherein said laminate matrix is formed into a pool cue stick.

3. The process of claim 1 wherein said laminate matrix is formed into a furniture item.

4. The process of claim 1 wherein said laminate matrix is formed into a sports item.

5. An artistic, decorative, durable and dimensionally stable laminate form having the appearance of ribbons laced and interspersed throughout the form, said laminate form comprising:

a first length of wood having a plurality of longitudinal, "X" axis, wave form cuts formed therethrough, thereby providing wave form surfaces common to each of said wave form cuts, a plurality of laminate strips of contrasting material, having characteristics of flexibility sufficient to conform with each of said wave form cuts, being bonded between each of said wave form surfaces, thereby forming a laminate matrix, a plurality of longitudinal "Y" axis, wave form cuts formed through said laminate matrix, thereby providing wave form surfaces common to each of said wave form cuts, a plurality of laminate strips of contrasting material, having characteristics of flexibility sufficient to conform with each of said wave form cuts, being bonded between each of said wave form surfaces, thereby forming a laminate matrix, and machining said matrix to such dimensions as required for the intended product and surface finishing said product such that the surface characteristics are enhanced thereby.

6. The artistic, decorative, durable and dimensionally stable laminate form of claim 5 wherein said laminate form is machined to form a pool cue stick.

7. The artistic, decorative, durable and dimensionally stable laminate form of claim 5 wherein said laminate form is machined to form a furniture item.

8. The artistic, decorative, durable and dimensionally stable laminate form of claim 5 wherein said laminate is machined to form a sports item.

* * * * *